United States Patent [19]

Thibodeaux et al.

[11] Patent Number: 4,509,883

[45] Date of Patent: Apr. 9, 1985

[54] RIG PILING CLAMP APPARATUS

[76] Inventors: Emile Thibodeaux, Rte. 3, Box 512; Robert Thibodeaux, 140 Samuel Dr., Lot 19, both of Eunice, La. 70535

[21] Appl. No.: 493,552

[22] Filed: May 11, 1983

[51] Int. Cl.[3] ..... E02D 7/00

[52] U.S. Cl. ..... 405/232; 405/228; 405/195

[58] Field of Search ..... 405/228, 196, 199, 166, 405/200, 197, 198, 231, 232

[56] References Cited

U.S. PATENT DOCUMENTS

| | | | |
|---|---|---|---|
| 2,967,400 | 1/1961 | Grant et al. | 405/199 |
| 3,422,505 | 1/1969 | Slemmons | 405/199 X |
| 3,680,322 | 8/1972 | Nolan et al. | 405/166 |
| 3,775,987 | 12/1973 | Rochelle et al. | 405/166 |
| 3,860,122 | 1/1975 | Cernosek | 405/166 X |
| 4,084,385 | 4/1978 | Boyadjieff | 405/228 |

*Primary Examiner*—Dennis L. Taylor

*Attorney, Agent, or Firm*—Bode & Smith

[57] ABSTRACT

A process involving the utilization of a clamp apparatus positioned around a pile to be driven into the seabed through the jacket leg and supported on the top end portion of the jacket leg itself. The apparatus involved in this process would comprise a pair of hemispherical sections hinged together at a common edge moveable between opened and closed positions opposite the hinged edge. There is further provided hydraulic means for effecting movement of the sections engaging or disengaging the piling. On the inner wall of each hemisphere there is further provided a plurality of protrusions, constructed of soft metal or the like, so that the outermost face of each protrusion engages the wall of the piling when the apparatus is in the closed position and engaged around the pile. The downward movement of the pile in the jacket leg is controlled by the loosening or tightening of the clamp apparatus by use of the hydraulic means attached thereto.

7 Claims, 6 Drawing Figures

RIG PILING CLAMP APPARATUS

BACKGROUND OF THE INVENTION

1. Field of the Invention

The present invention relates to the setting of jacket pilings used in the offshore drilling industry. More particularly, the present invention relates to devices to assist in the controlled setting of pilings into the sea bed within jacket legs.

2. General Background of the Invention

In the offshore oil industry jacket legs are often used to support a platform on which a drilling rig is placed. The jacket leg sits on the sea bed and pilings are driven into the sea bed through the hollow jacket legs to support the jacket and enable it to withstand wind and wave action so that a stable structure is provided.

Many times, when driving the initial piling, a soft layer is encountered through which the piling readily passes without force from the pile driver. This soft layer combined with the weight of the piling, from 100 to 200 tons, allows the piling to rapidly slide down the jacket leg and into the soft layer oftentimes resulting in damage to the piling, the jacket leg, or complete loss of the piling in the soft layer. The resulting damage and time involved in repair and/or replacement increases the set up time and cost for each jacket. To prevent this rapid sinking or running of the pile into the jacket leg it has been common in the industry to weld stops at intervals along the piling which would encounter the top edge of the jacket and hopefully prevent the pile from running into the jacket leg should a soft layer be encountered. The stops however are not always successful in stopping the pile should it begin to run because of its great weight. The stops often will shear off the pile and cause damage to the pile itself and the jacket leg. It is common that once the first set of stops is sheared off the remaining stops will also be sheared and will not prevent the pile from running down into the jacket leg.

The present invention relates to a clamp which is used to prevent the pile from running into the jacket leg. Utilizing the process and this particular clamp apparatus, time consuming and expensive procedure of welding stops to gradually lower the pile and removal of the stops to lower the pile into the jacket leg becomes unnecessary. The present invention allows controlled descent of the pile into the jacket leg when one of the soft layers in the sea bed is encountered. The following patents may be pertinent in the art:

U.S. Pat. No. 4,372,707 issued to Ostgard, discloses a hydraulic pile installation and removal mechanism for temporary jacking up rigs. Hydraulic jacks are attached to the pilings inside the pile guide. Slip mechanisms are used in conjunction the jacket to allow the pilings to be driven into the soil and also removal of the pilings from the soil and back into the pile guides when movement of the rig to a different location is necessary.

U.S Pat. No. 3,496,728 issued to Slack, discloses an apparatus and method for reinforcing offshore drilling and production platforms. A templet is positioned adjacent the platform and driven into the mud until a mud mat secured to the templet is at the mudline. The driving pipe is removed, the templet is secured to the platform, a piling is then driven into the ocean floor through the templet, and the piling is then clamped to the templet by special hubs for reinforcement of the templet and consequently, the platform.

U.S. Pat. No. 3,422,505 issued to Slemmons, discloses a gripper assembly used to support a base or platform on a column. Inflatable annular tubes are used to force seperate resilient gripping members against the suporting legs for the platform when the annular tubes are inflated.

U.S. Pat. No. 2,870,639 issued to Suderow, discloses a gripper and jack assembly for platforms. Upper and lower gripper shoes, moveably mounted on flexible members, are selectivey controllable by jack asemblies to move caissons down into contact with the sea bottom and raise the platform on the caissons.

GENERAL DISCUSSION OF THE INVENTION

The present invention relates to a process involving the utilization of a clamp apparatus positioned around a pile to be driven into the sea bed through the jacket leg and supported on the top end portion of the jacket leg itself. The apparatus involved in this process would comprise a pair of hemispherical sections hinged together at a common edge moveable between opened and closed positions opposite the hinged edge. There is further provided hydraulic means for effecting movement of the sections engaging or disengaging the piling. On the inner wall of each hemisphere there is further provided a plurality of protrusions constructed of soft metal or the like, so that the outermost face of each protrusion engages the wall of the piling when the apparatus is in the closed position and engaged around the pile. The downward movement of the pile in the jacket leg is controlled by the loosening or tightening of the clamp apparatus by use of the hydrulic means attached thereto.

In operation, the clamp apparatus is situated on the top portion of the jacket leg in a "disengaged" or open position, so as to allow the pile to slide into the jacket leg with the lowermost end of the pile resting on the diaphram on the foot of the jacket leg. A pile driver is provided for driving the pile through the diaphram of the jacket leg into the initial hard crust of the sea bed. Upon reaching a "soft" layer within the sea bed, a clamp apparatus is tightened, via the hydraulic means, for engaging the wall of the pile in a manner that would allow the pile to be driven by the pile driver but would frictionally prohibit the pile from "running" down into the jacket leg when the soft layer is reached and penetrated by the pile.

The clamp would then be periodically "disengaged" and "reengaged" around the pile wall in such a manner as to allow the pile to descend into the soft layer and down the jacket let at a controlled rate. When the uppermost end of the pile nears the clamp apparatus, the clamp is tightened to prevent further descent of the pile and the "pateyes" at the top of the clamp are removed and a second section of pile is placed or stabbed onto the top of the initial pile and welded onto the initial pile. The combined piling sections are then allowed, by loosening of the clamp, to descend into the soft layer in the sea bed. This process is continued until the next solid layer is reached into the sea bed. When that is reached the pile should no longer run freely down the jacket leg. The piles are then driven by the pile driver into the sea bed to give support to the jacket.

Therefore, it is an object of the present invention to provide a process and apparatus for controlling the descent of piles into jacket legs when a soft sea bottom is encountered.

It is a further object of the present invention to provide a process and apparatus wherein piles being inserted into jacket legs can be done so at a controlled rate and without fear of loosing pile within the leg.

In order to accomplish the above objects, it is a feature of the apparatus used in the process of the present invention to provide a pair of half-hinged sections for engaging and disengaging the wall of a pile at predetermined intervals during the pile driving process;

It is a further feature of the apparatus utilized in the process of the present invention to provide friction means on the inner walls of the sections for frictionally prohibiting the downward running of the pile upon encountering a jack hammer for driving into the sea bed.

DETAILED DESCRIPTION OF THE PREFERRED EMBODIMENT

Figure 1A:
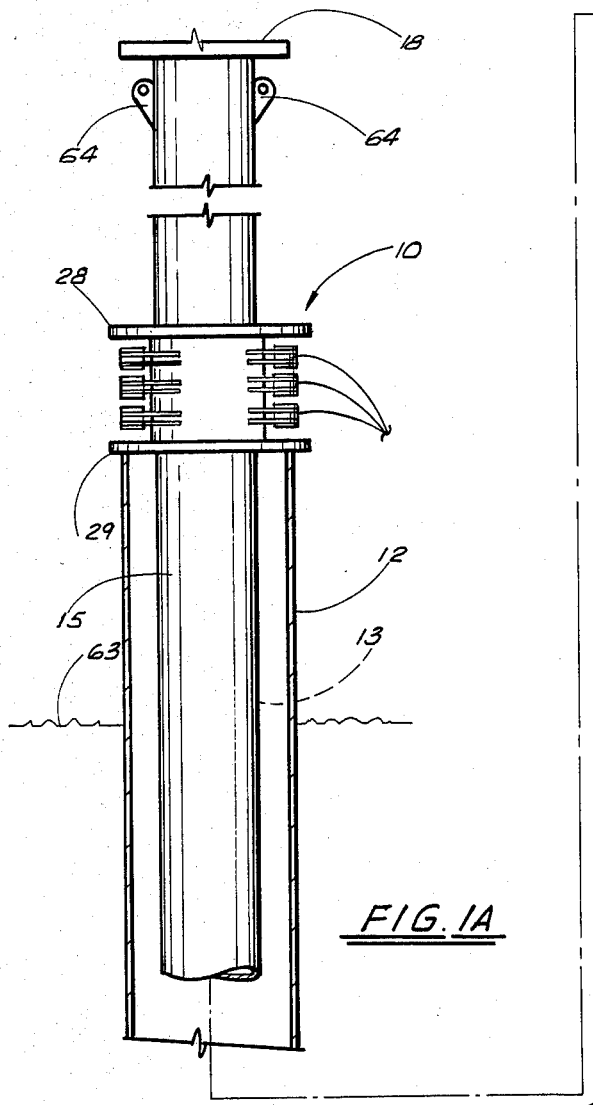
FIGS. 1A and 1B are overall side views of the preferred embodiment of the apparatus of the present invention illustrating the movement of a pile within the apparatus and sea bed thereunder.
Figure 1B:
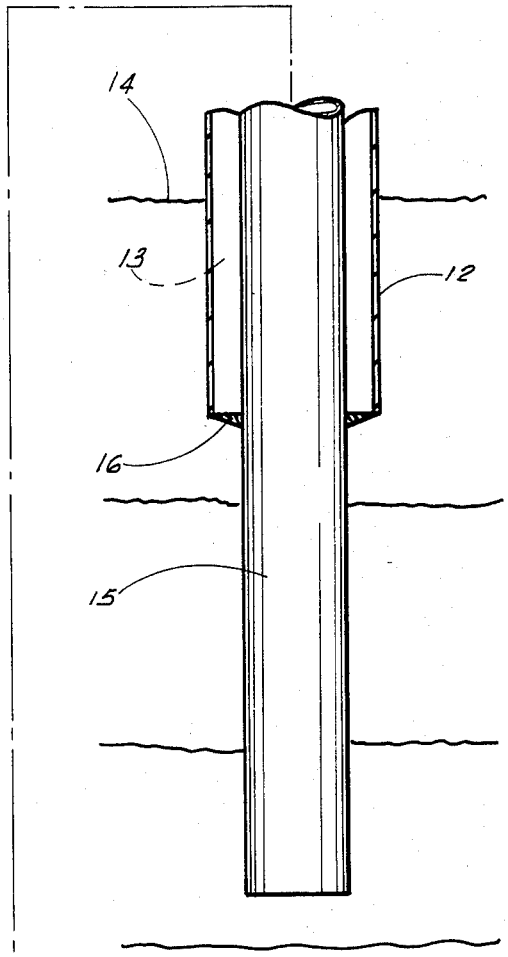

The preferred embodiment of the apparatus of the present invention is generally referred to in FIGS. 1 through 5 by the numeral 10. In order to more properly explain the functioning of apparatus 10, FIGS. 1A and 1B, for the most part help to illustrate the environment which the apparatus is utilized. In FIGS. 1A and 1B, there is illustrated rig jacket 12, which is one of the plurality of rig jackets which stand upright to support the body of the rig, in a seabed or the like. Rig jacket 12 is usually constructed of heavy metal, having an interior annulus 13 throughout its length. As seen in FIG. 1B, rig jacket 12 rests on the seabed 14 in helping to support the rig itself. Rig jacket 12 is hollow metal, there is provided an interior pile 15 which, is normally hoisted by a crane or the like into the upper annular base of the rig jacket and lowered into the rig jacket until it rests on the seabed. Pile 15, of course, serves to support each rig jacket so that in combination they can give support to the entire rig itself. As seen in FIG. 1A, rig jacket 12 provides a lower most rubber diaphram 16 which, for the most part, seals the lower most end of the rig jacket as it is lowered into the sea so that water or the like cannot seap into the rig jacket. Also, when the piling is resting on the bottom of the seabed within annulus 13 of rig jacket 12, rubber diaphram 16, although sealing, will allow the bottom of the pile to move through the diaphram into the seabed as seen in FIG. 1B. In the present state of the art, this is accomplished by having a pile driver or the like (not seen in Figures) using a pile hammer 18 to hammer the pile 15 down into the seabed. In FIG. 1B, as illustrated, pile 15 has been hammered via hammer 18 through the diaphram 16 and is inserted into seabed 14.

It is at this point that apparatus 10 becomes crucial in further driving of pile 15. As was explained earlier, there are layers beneath the surface of seabed 14, which are "soft" and due to the excessive weight (100 to 200 tons) of pile 15, when pile 15 encounters such a "soft" spot, pile 15 would tend to slide or run down jacket 12, thus, at times pile 15 being lost within the annulus 13 of jacket 12, and having to be retrieved. Due to its excessive weight, often times pile 15 has to be abandoned and a second pile attempted to drive through it.

Therefore, apparatus 10, as seen in the FIGURES, is being utilized in order to help prevent this type of result. What is provided in apparatus 10 as seen in FIGS. 1 through 5, is a pair of two principal hemispherical portions 22, 23 which are essentially mirror images of one another and are pivotally joined by a plurality of hinges 17, 18 and 19 along a first common edge 20 of each section 22 and 23, and defining an annulus 27 within portions 22 and 23. Hinges 17, 18 and 19, would be similar in structure having pairs of support plates 21 and 24 rigidly attached to the exterior wall 25 of each half section 22 and 23 by welding or the like. Support plates 21 and 24 would, for the most part, overlap having a common bore 26 that would coaxially line for housing pin 27 therethrough, with pin 27 serving as the axis for rotation of half portions 22 and 23 between opened and closed positions along common edge 20.

Figure 3:
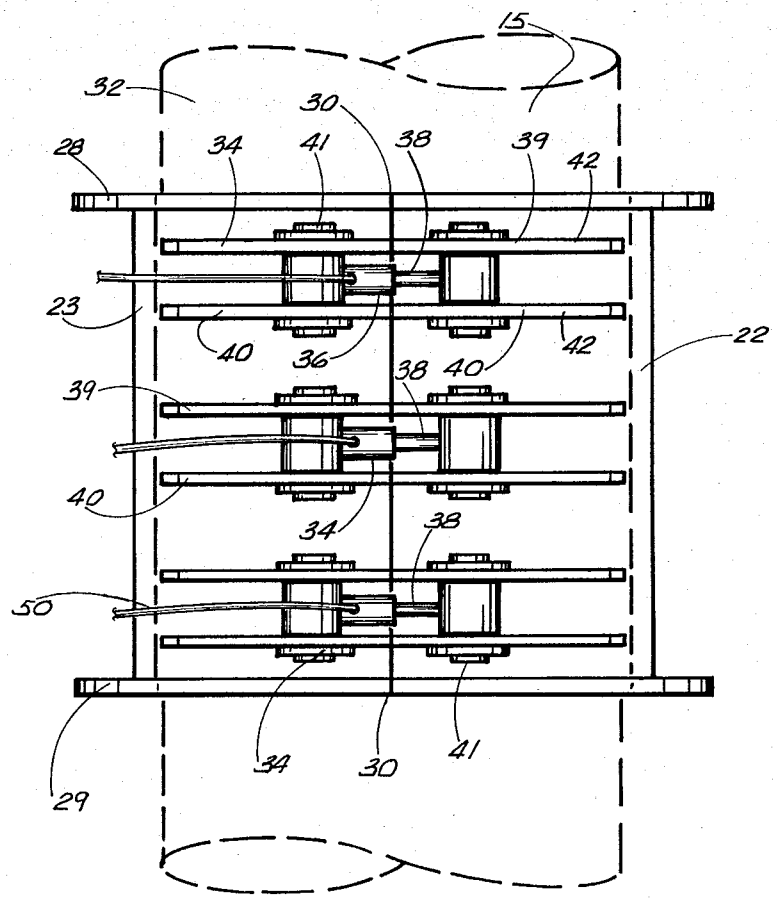
FIG. 3 is a side view of the preferred embodiment of the apparatus of the present invention illustrating the hydraulic means attached thereto.
Figure 2:
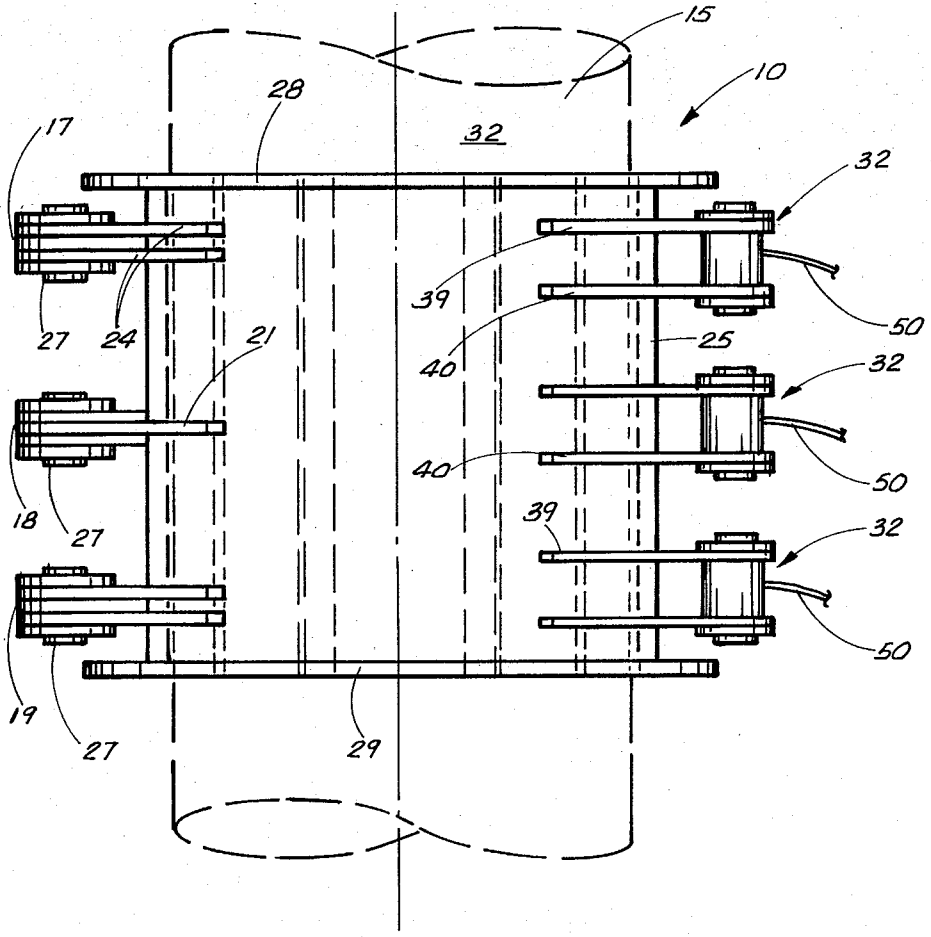
FIG. 2 is an overall side view of the preferred embodiment of the apparatus of the present invention.

As seen in the FIGURES, clamp apparatus 10 would further comprise upper and lower annular shoulder plates 28 and 29 respectively which are rigidly attached via welding or the like to the top and bottom edges of half portions 22, 23, and serve as means for positioning apparatus 10 on the upper most end of leg jacket 12, as seen in FIG. 1. Attached along a second common edge 30 and interconnecting sections 22 and 23, there is illustrated in FIG. 2, in side view, and FIG. 4 in top view, hydraulic means 32 which would comprise hydraulic jack portion 34 having cylinder portion 36 attached, as seen in FIG. 3, to hemisphere 23 by being pivotally mounted on upper and lower gusset mounting plates 39 and 40 respectively, via central mounting pin 41, wherein cylinder 36 is swivelly positioned there between brackets 39 and 40. The bracket mounting plates, provide an extended gusset plate section attached via welding and the like along their inner side portion via leading extended arm portion 42 providing additional strength for mounting along the side wall 25 of body portion 23. Likewise, there is further provided in jack portion 34, piston 38 which is slideably accomodated into cylinder 36, the end portion of piston 38 likewise swivelly mounted to gusset mounting brackets 39 and 40 respectively, with the mounting brackets 39 and 40 having identical structure and mounting means as that which is mounted cylinder 36. In the preferred embodiment, there would be at least three sets of hydraulic cylinders 34 along the length of clamp apparatus 10, as seen in FIG. 3, to give it an overall movement along common edge 30 for use with the apparatus, between opened and closed or engaging or non-engaging positions. As further seen in the FIGURES there is provided hydraulic lines 50 which supply hydraulic fluid from an hydraulic source not seen in the drawings for operative movement of the hydraulic cylinders 36 during operation. It should be noted that hydraulic means 32 are two-way hydraulic jacks which are abled to be controlled from a remote location and moved between opened and closed positions, i.e. piston 38 sliding inwardly into or outwardly out of cylinder 36, depending on the presence of hydraulic fluid within jack 34.

Figure 5:
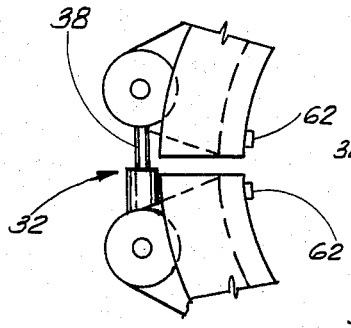
FIG. 5 is a partial top view of the preferred embodiment of the apparatus of the present invention in the open or "disengaged" position.
Figure 4:
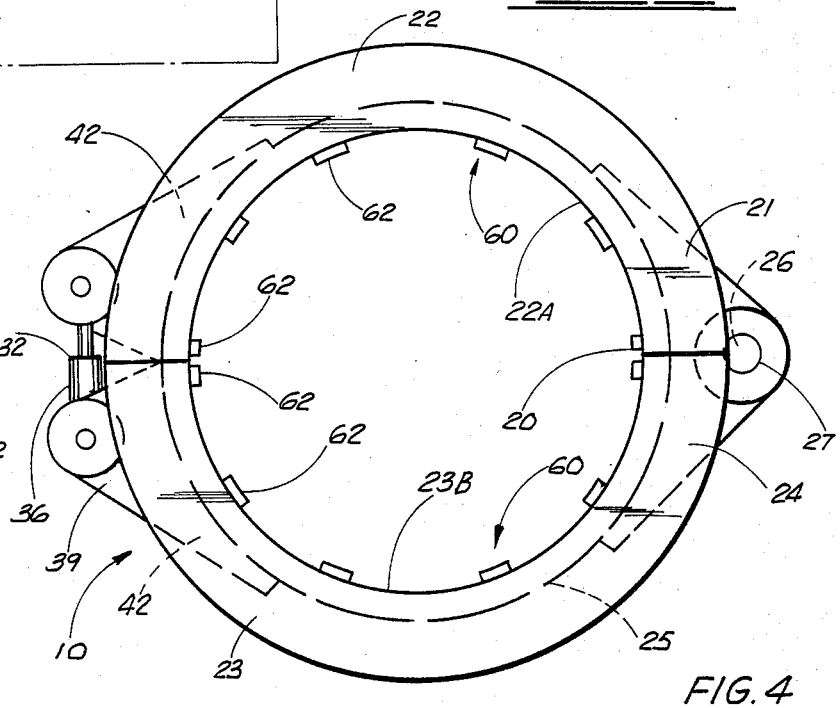
FIG. 4 is a top view of the preferred embodiment of the apparatus of the present invention illustrating the apparatus and the "engaged" or closed positon around the pile.

As further seen in FIGS. 4 and 5, apparatus 10 illustrated in the engaging or non-engaging positions around outer wall 25 of piling 15. In the preferred embodiment, in order to engage piling 15, there is attached to interior walls 22A and 23B, as illustrated in FIGS. 4 and 5, friction means 60 which protrudes from the interior wall 22A and 23B, as illustrated in FIG. 4, inwardly toward annular space 27. In the preferred embodiment friction means 60 would comprise a plurality of protrusions 62 substantially equally spaced longitudinally and circumferencially around interior walls 22A and 23B and constructed of a soft metal or the like in order to provide a gripping action on the outer wall 32 of piling 15 when clamp 10 is engaged around piling 15, therefore preventing or substantially decreasing the movement of piling 15 after it has been lowered into jacket 12, depending on the engaging or disengaging of apparatus 10.

In the operation of apparatus 10 when used in combination with jacket leg 12, which is a permanent platform used to support a drilling rig, the apparatus would be placed atop the end portion of jacket leg 12 protruding out of the water level 63 after jacket leg 12 has been positioned on the bottom of the seabed 14. Jacket leg 12 usually is one of the minimum of four jacket legs each of which must have a piling 15 lowered down into annulus 13 of jacket leg 12 and into seabed 14 at a sufficient depth to permanently anchor and support jacket 12. Piling 15 would usually consist of several sections welded together as necessary in order to obtain the necessary lift and would be constructed of a hollow steel piling with a wall thickness of 1 and 1½ to 2 and 2½ inches, normally in the neighborhood of 50 meters long and weighing anywhere from 100 to 200 tons. After jacket 12 is lowered into the water and rests on the seabed, a cap portion (not illustrated) is then removed from the top of the jacket 12 and clamp apparatus 10 is placed on the end portion of jacket leg 12 supported thereon by annular shoulder portion 29 with annular space 27 of apparatus 10 in coaxial allignment with annulus 13 of jacket leg 12. Following the opening of apparatus 10 via the use of hydraulic means 32, as seen in FIG. 5, piling 15 is then lowered through annulus 27 of apparatus 10 and lowered down through annulus 13 of jacket leg 12 by means of a crane line or the like attached to pateyes 64 at the top of piling 15, so that the lower end of piling 15 rests on rubber diaphram 16 at the bottom of jacket leg 12. Crane lines are then removed from pateyes 64 and weight 18 from a pile driver (not shown) is used to drive piling 15 through rubber diaphram 16 and into seabed 14.

In many parts of the world seabed 14 has an initial layer of crust which is fairly solid, a second layer which is very thin or semi-liquid, and a third layer which is again solid. This thickness or depth of these first two layers varies considerably. A pile driver must be used to drive piling 15 into the first solid layer. Due to the semi-liquid nature of the second layer and great weight of piling 15 the second layer will not support piling 15 when it reaches this second layer and piling 15 will rapidly sink or run into the second layer by virtue of the weight of piling 15 without aid of pushing force fromt he pile driver.

Clamp 10 is generally left in the open position, as seen in FIG. 5, when piling 15 is being driven through the first solid layer of seabed 14. When being driven into the first hard layer, piling 15 moves downwardly in small increments. As the bottom of piling 15 gets closer to the second soft layer of seabed 14, piling 15 begins to move downwardly a relatively greater distance with each stroke of the pile driver. When this indication is received, clamp 10 is tightened or engaged around piling 15 by the use of hydraulic means 32. Clamp 10 is tightened a sufficient amount so that protrusion 62 engage wall of piling 15 and prevent piling 15 from running uncontrolled into the soft layer and down jacket leg 12 when piling 15 breaks into the soft layer yet still allows controlled downward movement of piling 15 by use of force from the pile driver. This allows safe driving of piling 15 into seabed 14 as well as a means of supportig piling 15 when necessary to weld a second or third section presently in jacket leg 12.

When the third solid layer of seabed 14 is reached, piling 15 moves downwardly in small increments again with each stroke of the pile driver. This is an indication that the layer will support the weight of piling 15 and that clamp 10 can be loosened safely without piling 15 running down jacket 12. Clamp 10 is then loosened and piling 15 is driven to the necessary depth to adequately support jacket leg 12. Although the description of the invention describes specific elements and embodiments, it should not be read so as to limit the scope of the present invention.

Because may varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for engaging and disengaging a rig piling being lowered into a rig jacket leg, which comprises:

a. first and second shell portions having continuous side walls and hingedly attached at a common edge, said shell portions supported on said jacket leg;

b. means interconnecting said first and second shell portions along a second edge for forcibly moving said first and second shell portions between a closed position engaging said rig piling and an open position disengaging said rig piling;

c. means contained on the inner wall of each of said shell portions for frictionally engaging the wall of said piling, and allowing controlled movement of said piling when said shell portion are forcibly moved into substantially closed positions.

2. The apparatus in claim 1, wherein said first and second shell portions further comprise upper and lower annular shoulder portions rigidly attached to and extending outwardly from the top and bottom edges of said apparatus for supporting said apparatus on the end portion of a leg jacket of said rig during use.

3. The apparatus in claim 1, wherein said friction means further comprises a plurality of protrusions spaced along the interior walls of said first and second shell portions.

4. An apparatus for engaging and disengaging a rig piling being lowered into a rig leg jacket, comprising:

a. first and second shell portions having continuous side walls and hingedly attached at a common edge moveable between opened and closed positions;

b. hydraulic means interconnecting said first and second shell portions at a second edge for moving said first and second shell portions between said opened and closed positions for engaging or disengaging the rig piling;

c. a plurality of protrusions spaced along the interior wall of said first and second shell portions for frictionally engaging the wall of said rig piling and allowing controlled downward movement of said piling within said rig leg jacket when said first and second shell portions are in substantially closed positions, and for disengaging the rig leg piling when said first and second shell portions are in the open position; and d. means for supporting said clamp apparatus on the top portion of said rig jacket during use of said apparatus.

5. The apparatus in claim 4, wherein said hydraulic means further comprises at least three hydraulic jacks positioned between and inter-connecting said first and second shell portions for providing opening and closing movement to said shell portions and controlling movement of said piling.

6. The apparatus in claim 4, wherein said plurality of protrusions are substantially hard metal or like substance.

7. A method of controlling the lowering of a rig piling to the sea bed, which comprises the following steps:

a. providing a rig jacket having an annulus therethrough and positioned upright and in contact with the sea bed;

b. resting a clamp on the end of said rig jacket leg, said clamp comprising;

i. first and second shell portions having continuous side walls, and hingedly attached at a common edge, said side walls defining an annulus therethrough;

ii. means interconnecting said first and second shell portions along a second edge for moving said portions between open and closed positions; and iii. a plurality of friction means contained on the inner wall of said shell portions for engaging the wall of the piling when said shell portions are in substantially closed positions;

c. coaxilly alligning the annulus of said clamp with the annulus of said jacket leg;

d. lowering a rig piling through said coaxial annulii into said rig jacket;

e. driving said piling into the sea bed with a pile driver or the like;

f. closing said shell portions around said piling to engage the wall of said piling, preventing movement of said pilings;

g. further driving said piling into said seabed against the resistance of said friction means; and h. disengaging said clamp when said piling decreases movement within said seabed.

* * * * *

UNITED STATES PATENT AND TRADEMARK OFFICE

CERTIFICATE OF CORRECTION

PATENT NO. : 4,509,883

DATED : April 9, 1985

INVENTOR(S) : Emile Thibodeaux
Robert Thibodeaux

It is certified that error appears in the above-identified patent and that said Letters Patent are hereby corrected as shown below:

In the abstract, on line 5, the word "hemispherical" should read -- shell --.

In column 2, line 21, the word "hemispherical" should read -- shell --.

In column 4, line 16, the word "hemispherical" should read -- shell (i.e. semi circular) --.

In Column 4, line 17, after the number 23, insert --(see Figure 4)--.

In Column 4, line 41, "hemisphere" should be --shell portion--.

Signed and Sealed this

*Seventeenth* Day of *September 1985*

[SEAL]

*Attest:*

*Attesting Officer*

DONALD J. QUIGG

*Commissioner of Patents and Trademarks—Designate*

UNITED STATES PATENT OFFICE

CERTIFICATE OF CORRECTION

PATENT NO. : 4,509,883

DATED : Apr. 9, 1985

INVENTOR(S) : Emile Thibodeaux and Robert Thibodeaux

It is certified that error appears in the above-identified patent and that said Letters Patent are hereby corrected as shown below:

IN THE ABSTRACT:

Line 5, change "hemispherical" to --hemicylindrical--.

Lines 10-11, change "hemisphere" to --hemicylinder--.

COLUMN 2:

Line 19, change "hemispherical" to --hemicylindrical--.

Line 24, change "hemisphere" to --hemicylinder--.

COLUMN 4:

Line 16, change "hemispherical" to --hemicylindrical--.

Line 41, change "hemisphere" to --hemicylinder--.

Signed and Sealed this

*Third* Day of *December 1985*

[SEAL]

*Attest:*

DONALD J. QUIGG

*Attesting Officer*

*Commissioner of Patents and Trademarks*